US006881439B2

(12) United States Patent
Graham et al.

(10) Patent No.: US 6,881,439 B2
(45) Date of Patent: Apr. 19, 2005

(54) ALUMINIDE COATING PROCESS

(75) Inventors: Stephen Daniel Graham, Simpsonville, SC (US); John Herbert Wood, St. Johnsville, NY (US); Cyril Gerard Beck, Greenville, SC (US); Warren Tan King, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 122 days.

(21) Appl. No.: 10/065,959

(22) Filed: Dec. 4, 2002

(65) Prior Publication Data

US 2004/0109948 A1 Jun. 10, 2004

(51) Int. Cl.[7] ..... B05D 7/22; B05D 7/00; B05D 3/02

(52) U.S. Cl. ..... 427/142; 427/140; 427/239; 427/229; 427/376.6; 427/376.8; 427/383.1; 427/383.7

(58) Field of Search ..... 427/140, 142, 427/230, 229, 239, 376.6, 376.8, 383.1, 383.7

(56) References Cited

U.S. PATENT DOCUMENTS

| | | | | | |
|---|---|---|---|---|---|
| 5,254,413 | A | * | 10/1993 | Maricocchi | 428/633 |
| 5,795,659 | A | * | 8/1998 | Meelu et al. | 428/610 |
| 6,326,051 | B1 | | 12/2001 | Nakasogi et al. | 426/656 |
| 6,444,054 | B1 | | 9/2002 | Kircher et al. | 148/248 |
| 2003/0152705 | A1 | * | 8/2003 | Pfaendtner et al. | 427/376.1 |

* cited by examiner

*Primary Examiner*—Michael Barr
(74) *Attorney, Agent, or Firm*—William Genovese; Gary M. Hartman; Domenica N. S. Hartman

(57) ABSTRACT

An aluminiding process that enables the cooling holes of an air-cooled component, such as a hot gas path component of a gas turbine engine, to be machined and then aluminized after all external surface coatings have been deposited. The aluminide coating is deposited using a slurry process capable of forming the aluminide coating on the component without damaging an existing ceramic coating on the component. The process involves applying an activator-free slurry containing aluminum particles that, when the component is sufficiently heated, melt and diffuse into the component surface to form the diffusion aluminide coating.

16 Claims, 1 Drawing Sheet

ALUMINIDE COATING PROCESS

BACKGROUND OF INVENTION

1. Field of the Invention

The present invention relates to processes for forming aluminide coatings. More particularly, this invention relates to a process of forming an aluminide coating on a surface of a component having an existing thermal barrier coating without causing spallation of the thermal barrier coating.

2. Description of the Related Art

The operating environment within a gas turbine engine is both thermally and chemically hostile. Significant advances in high temperature capabilities have been achieved through the development of iron, nickel and cobalt-base superalloys and the use of oxidation-resistant environmental coatings capable of protecting superalloys from oxidation, hot corrosion, etc. Aluminum-containing coatings, particularly diffusion aluminide coatings, have found widespread use as environmental coatings on gas turbine engine components. Aluminide coatings are generally formed by a diffusion process such as pack cementation or vapor phase aluminizing (VPA) techniques, or by diffusing aluminum deposited by chemical vapor deposition (CVD) or slurry coating. During high temperature exposure in air, an aluminide coating forms a protective aluminum oxide (alumina) scale or layer that inhibits oxidation of the coating and the underlying substrate.

Slurry coatings used to form aluminide coatings contain an aluminum powder in an inorganic binder, and are directly applied to the surface to be aluminized. Aluminizing occurs as a result of heating the component in a non-oxidizing atmosphere or vacuum to a temperature that is maintained for a duration sufficient to melt the aluminum powder and diffuse the molten aluminum into the surface. As described in U.S. Pat. No. 6,444,054, slurry coatings may contain a carrier (activator), such as an alkali metal halide, which vaporizes and reacts with the aluminum powder to form a volatile aluminum halide, which then reacts at the component surface to form the aluminide coating. Because the thickness of an aluminide coating produced by a slurry method is proportional to the amount of the slurry applied to the surface, the amount of slurry applied must be very carefully controlled. While the presence of a halide is believed to displace oxides on the surface being treated, making it more likely that a clean uniform diffusion coating will result, the inability of slurry processes to consistently produce diffusion aluminide coatings of uniform thickness has discouraged their use on components that require a very uniform diffusion coating and/or have complicated geometries, such as turbine blades.

In contrast to slurry processes, pack cementation and VPA processes are widely used to form aluminide coatings because of their ability to form coatings of uniform thickness. Both of these processes generally entail reacting the surface of a component with an aluminum halide gas formed by reacting an activator (e.g., an ammonium or alkali metal halide) with an aluminum-containing source (donor) material. In pack cementation processes, the aluminum halide gas is produced by heating a powder mixture comprising the source material, the activator, and and inert filler such as calcined alumina. The ingredients of the powder mixture are mixed and then packed and pressed around the component to be treated, after which the component and powder mixture are heated to a temperature sufficient to vaporize the activator, which reacts with the source material to form the volatile aluminum halide, which then reacts at the component surface to form the aluminide coating. In contrast to pack processes, VPA processes are carried out with the source material placed out of contact with the surface to be aluminized. The source material can be an aluminum alloy or an aluminum halide, the latter of which eliminates the requirement for a separate activator. Aside from certain limited exceptions, such as a pack cementation process taught by U.S. Pat. No. 5,254,413 to Maricocchi and a VPA process taught by U.S. Pat. No. 6,326,057 to Das et al., both of which are assigned to the assignee of this invention, all conventional pack cementation and VPA processes have required the use of halide carriers or activators.

Components located in certain sections of gas turbine engines, such as the turbine, combustor and augmentor, require some form of thermal protection in addition to an environmental coating. One approach is to deposit a thermal barrier coating (TBC) on the external surfaces of the component. TBC's must have low thermal conductivity, strongly adhere to the article, and remain adherent throughout many heating and cooling cycles. Coating systems capable of satisfying these requirements generally comprise a ceramic layer adhered to the component surface with an aluminum-containing bond coat, such as a diffusion aluminide coating or, more typically, an overlay coating deposited by thermal spraying or a physical vapor deposition (PVD) technique. At times, TBC is intentionally applied on limited surface regions of a component, such as those surface exposed to particularly high temperatures. TBC may also be unintentionally applied to limited regions of the component surface if TBC deposition is blocked because of the part geometry, as can happen with multi-airfoil vanes. In these cases, an aluminide coating can be applied to all exposed surfaces of a component prior to TBC deposition in order to protect those surfaces not protected by the TBC.

Another approach for providing thermal protection is to configure the component to provide cooling air flow through internal passages within the component, such that heat is absorbed from the external surfaces through the component walls. Certain air-cooled components are designed so that the cooling air is released into the gas path at specific locations on the component surface to provide a layer of cooling air flow over the component surface, creating a boundary layer (film) that reduces heat transfer from the hot gas path to the component. Temperatures inside internal cooling passages can be sufficiently high to require a diffusion aluminide coating for oxidation protection.

For more demanding applications, it becomes necessary to utilize internal cooling in combination with a TBC on the external surfaces of a gas turbine engine component. Particular examples are those components that are subjected to temperatures that exceed the melting temperature of the alloy from which they are formed. However, the size and geometry of film cooling holes for an air-cooled component are critical to maintaining the required amount of coolant flow, as well as the air flow pattern required to create the desired film boundary. If cooling holes are formed before any external coatings are applied, the final configuration of the hole opening is difficult to maintain and measure. For example, thermally-sprayed bond coats are typically deposited in one or more applications having tolerances that may be on the order of about 20% to 30%. TBC's applied by some form of thermal spray process, such as plasma spraying, high velocity oxy-fuel (HVOF), etc., are also inherently difficult to control on a local scale. As a result, the precise size and shape of a film cooling hole and other small, well-defined, features present in a component surface are lost, blurred, or otherwise altered by the subsequent deposition of a protective coating. On the other hand, processing complications are encountered if cooling holes are formed after the deposition of a protective coating. For example, bond coats are formed of hard, brittle materials that are very difficult to machine. Furthermore, the aluminide coatings desired for the internal cooling passages cannot be deposited after TBC deposition because the halide activator required by aluminide coating processes traditionally suitable for gas turbine components are incompatible with TBC materials. A TBC exposed during such an aluminizing process de-bonds or spalls from the component, leaving the area underneath with little or no thermal protection. Consequently, gas turbine engine components requiring both air cooling and TBC for thermal protection have been designed so that their cooling holes are properly sized after bond coat and TBC deposition, or their holes must be reopened after TBC deposition with the risk of damage to the aluminide coating protecting the cooling hole. Such damage to the internal aluminide coating is virtually impossible to detect and can lead to premature failure of the component.

In view of the above, it can be appreciated that the ability to combine cooling air flow, TBC, and aluminized cooling holes in the same component has not been fully realized because aluminized cooling holes are prone to damage when attempting to reestablish their shape and size after bond coat and TBC deposition, and the aluminizing of cooling holes after bond coat and TBC deposition is prohibited by the reaction that occurs between the halide and TBC. As a result of the latter, virtually all TBC-coated air-cooled gas turbine engine components equipped with film cooling holes have been manufactured according to the following sequence: machine the cooling holes; aluminide coat the cooling holes; and then deposit the TBC over the pre-machined, pre-coated, cooling holes, with the result that the cooling holes are at least partially blocked with TBC. It is believed that all prior attempts to rearrange the manufacturing sequence so that cooling hole machining and internal aluminide coating are performed after TBC deposition have failed because of the incompatibility of the halide activator and TBC materials.

Because TBC's are frangible, TBC-coated components are at risk of damage from handling that can lead to the loss of thermal protection, resulting in a local increase in component temperature during engine operation that may be unacceptable if the chipped region is sufficiently large. In this case, the TBC must typically be stripped from the entire component and reapplied. If the component is air-cooled, the reapplied TBC must be removed from the cooling holes in order to reestablish their size and geometry. As previously discussed, any aluminide coating present within a cooling hole that must undergo refurbishment in this manner is prone to damage and even removal when attempting to remove the TBC blocking the hole. Therefore, in addition to the desirability of combining different forms of thermal protection, it would be advantageous if, during the repair of a TBC-coated component, the oxidation resistance of the exposed bond coat could be enhanced by local application of an aluminide, instead of completely stripping and recoating the entire component. Furthermore, it would be advantageous if a component having TBC applied to only limited external surfaces (whether intentional or not) could be aluminized after TBC deposition to provide environmental protection on those surfaces not covered by the TBC. However, each of these capabilities has also been frustrated by the incompatibility between TBC and the halide activators used in aluminizing processes.

SUMMARY OF INVENTION

The present invention is an aluminiding process that enables the cooling holes of an air-cooled component, such as a hot gas path component of a gas turbine engine, to be machined and aluminized after all other surface coatings have been deposited. This sequence eliminates the previous requirement to machine the cooling holes before any coatings are applied, which resulted in the size and shape of the cooling holes, and hence the cooling flow characteristics of the component, being undesirably altered by the deposited coatings.

The invention is generally a slurry process for forming an aluminide coating. According to this invention, the process is able to form a diffusion aluminide coating on a component having a ceramic coating on a first surface thereof, without damaging the ceramic coating. The process involves applying an activator-free slurry on a second surface of the component that is not covered by the ceramic coating. The slurry contains aluminum particles that, when the component is heated in an inert or reducing atmosphere, melt and the resulting molten aluminum diffuses into the second surface of the component, thereby forming the desired diffusion aluminide coating on the second surface.

In view of the above, the process of this invention is able to produce a diffusion aluminide coating without the use of a halide carrier or activator. As a result, the process can be employed to aluminize the internal surfaces of cooling holes of an air-cooled component after deposition of a TBC required to thermally protect the external surfaces of the component. The invention is also useful in other circumstances where it is desirable to aluminize a surface of a component having an existing TBC, such as when repairing or refurbishing a diffusion bond coat exposed by a spalled region of TBC.

Other objects and advantages of this invention will be better appreciated from the following detailed description.

DETAILED DESCRIPTION

The present invention is generally applicable to components that operate within thermally and chemically hostile environments, and are therefore subjected to oxidation, hot corrosion and thermal degradation. Examples of such components include the high and low pressure turbine nozzles, blades and shrouds of gas turbine engines. While the advantages of this invention will be described with reference to gas turbine engine hardware, the teachings of the invention are generally applicable to any component on which both an aluminide coating and a TBC are used to protect the component from its hostile operating environment.

Figure 1:
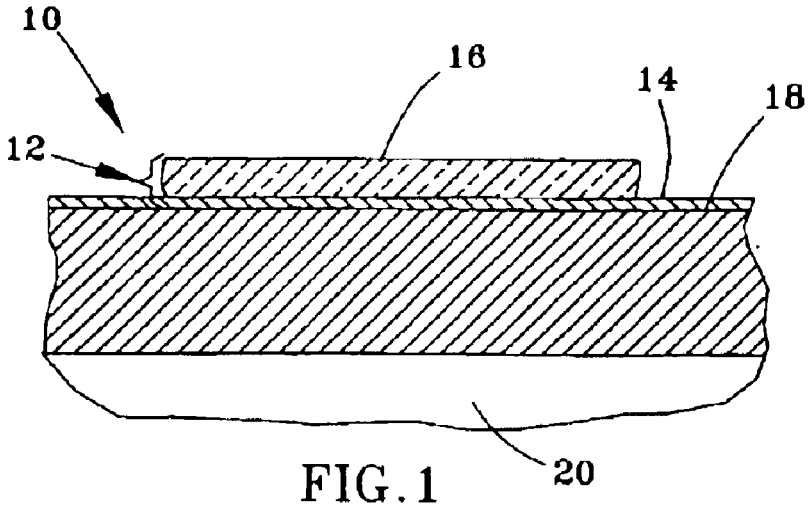
FIGS. 1, 2 and 3 represent partial cross-sectional views of an air-cooled component having a TBC on an external surface thereof, and illustrates the steps of machining a cooling hole in the component (FIG. 2) and then aluminiding the internal surface of the hole without spalling the TBC on the external surface (FIG. 3) in accordance with this invention.

FIG. 1 represents a partial cross-section of a gas turbine engine component 10, such as a turbine blade, whose external surface 18 is protected by a thermal barrier coating (TBC) system 12. The TBC system 12 is shown as including a bond coat 14 on which a ceramic TBC 16 is deposited. Typical materials for the component 10 include nickel, iron and cobalt-base superalloys, though other alloys could be used. The TBC 16 may be deposited by thermal spraying such as air plasma spraying (APS), low pressure plasma spraying (LPPS) and HVOF, or by a physical vapor deposition technique such as electron beam physical vapor deposition (EBPVD). A preferred material for the TBC 16 is zirconia partially stabilized with yttria (yttria-stabilized zirconia, or YSZ), though zirconia fully stabilized with yttria could be used, as well as zirconia stabilized by other oxides, such as magnesia (MgO), calcia (CaO), ceria ($CeO_2$) or scandia ($Sc_2O_3$). The bond coat 14 serves to adhere the ceramic TBC 16, and will typically be a thermal-sprayed overlay coating (e.g., MCrAlY) if the TBC 16 is deposited by thermal spraying, or a diffusion aluminide if the TBC 16 is deposited by PVD. When sufficiently heated in an oxidizing atmosphere, the coating 14 develops an alumina ($Al_2O_3$) layer or scale (not shown) on its surface that protects the underlying superalloy surface 18 from oxidation.

Figure 2:
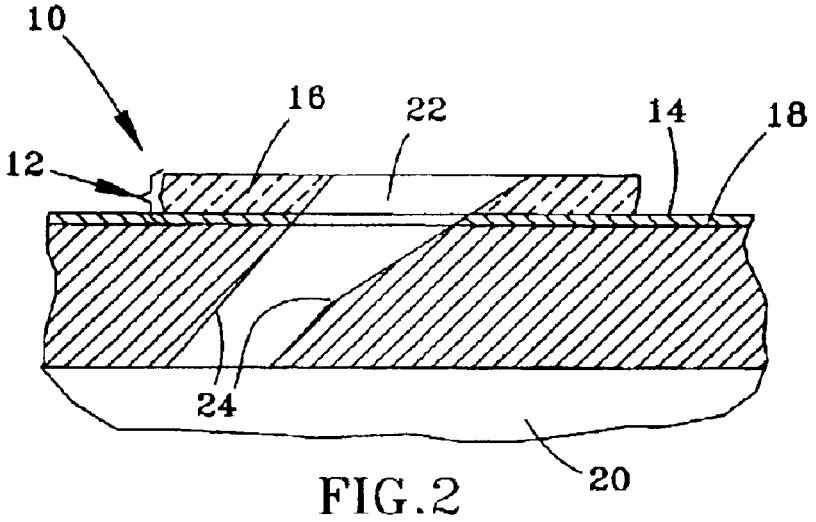

According to this invention, the component 10 is desired to be film air-cooled, requiring the creation of cooling holes between the component surface 18 and an internal passage 20 within the component 10. A representative cooling hole 22 is depicted in FIG. 2, and is shown as having been machined by any suitable technique through the wall of the component 10 defined between the external surface 18 and internal passage 20. To protect the internal surface 24 defined by the hole 22, a diffusion aluminide coating 26 (FIG. 3) is formed by a slurry process by which aluminum is diffused into the surface 24 to form aluminide intermetallics. As with conventional diffusion aluminide coatings, the aluminide coating 26 of this invention is characterized by two distinct zones (not shown), namely, an outermost additive layer containing MAl intermetallic compounds and a diffusion zone beneath the additive layer and comprising various intermetallic and metastable phases.

Figure 3:
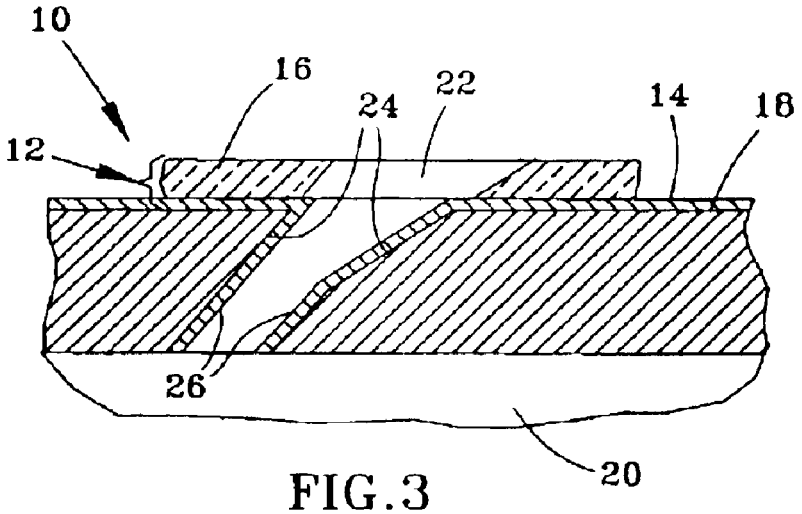

As represented in FIG. 3, the slurry process of this invention is capable of forming the aluminide coating 26 without de-bonding the TBC 16. For this purpose, the slurry process makes use of an aluminum-containing slurry that does not contain a halide activator or other ingredient that would damage the TBC 16 or the alumina scale on the surface of the bond coat 14. Instead, the slurry process relies entirely on the aluminum contained within the slurry, which is melted and diffused into the surface 24 of the cooling hole 22 by heating the component 10 to a temperature that is maintained for a duration sufficient to melt and diffuse the aluminum into the surface 24 to form the diffusion aluminide coating 26. Suitable slurry compositions for this purpose are commercially available, such as SermAlcote from Sermatech International, Inc., and Alseal 625 from Coatings for Industry, Inc. Alseal 625 is reported to contain, by weight, about 4.2% silicon, 37.7% aluminum powder, and the balance a phosphate/chromate solution, 3.3 weight percent of which is $CrO_3$. Each of these slurry compositions can be applied by conventional spraying equipment, and if deposited to have a uniform thickness is capable of forming a diffusion aluminide coating of a desirable uniform thickness, such as on the order of about 0.002 to 0.004 inch (about 0.05 to about 0.1 mm). Prior to applying the slurry, the surfaces on which the slurry will be applied may undergo surface preparations typical for TBC deposition, such as sanding. Notably, special surface preparations were not found to be necessary for the compatibility or efficacy of the slurry and existing TBC.

After applying the slurry, the diffusion process is performed in an inert or reducing atmosphere (such as argon or hydrogen, respectively) within a coating chamber (retort) that contains only the slurry-coated components. Coating conditions within the retort will depend in part on the desired thickness of the aluminide coating 26 and the aluminum content of the slurry, with suitable coating parameters including temperatures of about 1750° F. to about 2000° F. (about 960° C. to about 1090° C.), held for durations from about fifteen minutes to about four hours. Using the above coating conditions, the slurry coating process of this invention has been shown to form an acceptable diffusion aluminide coating on a nickel-base substrate without any deleterious effect on an yttria-stabilized zirconia TBC on the same substrate.

During an investigation leading to this invention, twelve one-inch (about 2.5 cm) diameter buttons were prepared of a single-crystal nickel-base superalloy commercially known as GTD-111 and having a nominal composition, in weight percent, of Ni-14.0Cr-9.5Co-3.0Al-4.9Ti-1.5Mo-3.8W-2.8Ta-0.010C. Each button had one surface coated with a TBC system comprising an MCrAlY bond coat (where M is nickel, cobalt and/or iron) deposited by LPPS (also referred to as vacuum plasma spraying (VPS)), on which a TBC top coat of zirconia stabilized by about 4 to 8 weight percent yttria was deposited by air plasma spraying (APS) to a thickness of about 0.012 inch (about 0.3 mm). Six of the twelve buttons were set aside as baseline specimens, while the remaining six buttons were completely coated with the SermAlcote slurry to a thickness of about 0.020 to 0.080 inch (about 0.5 to about 2 mm). After drying the slurry coatings at room temperature overnight, the six slurry-coated buttons underwent currying at about 600° F. (about 320° C.) for about thirty minutes, followed by a diffusion heat treatment at a temperature of about 1950° F. (about 1065° C.) for a duration of about two hours in an evacuated retort, resulting in the six buttons developing diffusion aluminide coatings on those surfaces free of the TBC. Residual aluminum was not observed on the TBC on which the slurry had been deposited.

All twelve buttons were then subjected to thermal cycle testing. Three of the aluminized buttons and three baseline buttons were cycled between room temperature and about 2000° F. (about 1090° C.) with a forty-five minute soak at the elevated temperature, while the remaining three aluminized buttons and three baseline buttons were cycled between room temperature and about 2000° F. (about 1090° C.) with a twenty-hour soak at the elevated temperature. All buttons were cycled until about 10 percent of the surface area of the TBC had spalled. Results of the thermal cycle tests are summarized in Table 1 below. [t1]

TABLE I

| | Cycles to Spallation | Cycles to Spallation |
|---|---|---|
| Specimen | 2000° F./45 min hold | 2000° F./20 hr hold |
| Baseline | 440 | 29 |
| | 560 | 45 |
| | 869 | 35 |
| Slurry-coated | 600 | 20 |
| | 620 | 45 |
| | 620 | 55 |

From this investigation, it can be seen that no significant difference in spallation resistance was apparent between the baseline and aluminized buttons. It was therefore concluded that the slurry process is capable of producing a diffusion aluminide coating on a surface of a substrate without damaging an existing TBC on the same substrate.

What is claimed is:

1. A process of forming a diffusion aluminide coating on a component having a ceramic coating on a first surface thereof, the process comprising the steps of:

applying a substantially uniform coating of an activator-free slurry on a second surface of the component that is not covered by the ceramic coating, the slurry consisting essentially of aluminum particles in an organic binder solution; and then in an inert or reducing atmosphere, heating the component to melt the aluminum particles and diffuse aluminum into the second surface of the component and thereby form a diffusion aluminide coating on the second surface, the ceramic coating being substantially undamaged by the slurry during the heating step.

2. A process according to claim 1, wherein the second surface is an internal surface defined by a hole in the component, and the first surface is an external surface intersected by the hole.

3. A process according to claim 2, further comprising the steps of depositing the ceramic coating on the first surface of the component, and then machining the hole in the component prior to applying the slurry.

4. A process according to claim 1, wherein the applying step comprises spraying the slurry on the second surface.

5. A process according to claim 1, wherein the applying step comprises applying the coating on the slurry on the second surface and on the ceramic coating.

6. A process according to claim 1, wherein the component is heated to about 960° C. to about 1090° C.

7. A process according to claim 1, wherein the component is formed of a superalloy.

8. A process according to claim 1, wherein the component is an air-cooled gas turbine engine component.

9. A process of forming a diffusion aluminide coating on a component having a ceramic coating on a first surface thereof, the process comprising the steps of:

applying a substantially uniform coating of an activator-free slurry on a second surface of the component that is not covered by the ceramic coating, the slurry containing aluminum particles is an inorganic binder solution; and the in an inert or reducing atmosphere, heating the component to melt the aluminum particles and diffuse aluminum into the second surface of the component and thereby form a diffusion aluminide coating on the second surface, the ceramic coating being substantially undamaged by the slurry during the heating step, wherein the process repairs a portion of a diffusion aluminide bond coat on the second surface and exposed by a spalled region of the ceramic coating.

10. A process for forming a diffusion aluminide coating on an air-cooled superalloy component of a gas turbine engine, the process comprising the steps of:

depositing a ceramic coating on an external surface of the component;

machining holes in the component to define internal surfaces within the component, the holes intersecting the external surface of the component and at least one internal passage within the component;

applying a substantially uniform coating of an activator-free slurry to the internal surfaces of the component, the slurry containing essentially of aluminum particles in an organic binder solution;

drying the coating; and then in an inert or reducing atmosphere, heating the component to a temperature of about 960° C. to about 1090° C. that is held for a duration sufficient to melt the aluminum particles, diffuse aluminum into the internal surfaces, and form a diffusion aluminide coating on the internal surfaces, the ceramic coating being substantially undamaged by the slurry during the heating step.

11. A process according to claim 10, wherein the applying step comprises flowing the slurry through the internal passage and the holes to deposit the coating on the internal surfaces.

12. A process according to claim 10, wherein the applying step comprises applying the coating on the internal surfaces and on the ceramic coating.

13. A process according to claim 10, wherein the slurry consists of the aluminum and the inorganic binder solution.

14. A process according to claim 1, wherein the slurry consits essentially of the aluminum particles, the inorganic binder solution, silicon and chromia.

15. A process according to claim 1, wherein the slurry consists of the aluminum particles, the inorganic binder solution, silicon and chromia.

16. A process according to claim 2, wherein the applying step comprises flowing the slurry through the hole in the component to deposit the coating.

* * * * *